US010875325B2

(12) United States Patent
Vicktorius et al.

(10) Patent No.: US 10,875,325 B2
(45) Date of Patent: Dec. 29, 2020

(54) DEVICE AND METHOD FOR PRINTING LABELS BY MEANS OF THERMAL PRINTING

(71) Applicant: ESPERA-WERKE GmbH, Duisburg (DE)

(72) Inventors: Winfried Vicktorius, Duisburg (DE); Marcus Korthäuer, Mülheim an der Ruhr (DE); Peter Wolff, Swisttal-Heimerzheim (DE)

(73) Assignee: Espera-Werke GmbH, Duisburg (DE)

( * ) Notice: Subject to any disclaimer, the term of this patent is extended or adjusted under 35 U.S.C. 154(b) by 279 days.

(21) Appl. No.: 15/766,811

(22) PCT Filed: Aug. 25, 2016

(86) PCT No.: PCT/EP2016/070051

§ 371 (c)(1),
(2) Date: Apr. 7, 2018

(87) PCT Pub. No.: WO2017/076533

PCT Pub. Date: May 11, 2017

(65) Prior Publication Data

US 2018/0297376 A1 Oct. 18, 2018

(30) Foreign Application Priority Data

Nov. 2, 2015 (DE) ..... 10 2015 118 732

(51) Int. Cl.
*B41J 3/407* (2006.01)
*B41J 2/32* (2006.01)
(Continued)

(52) U.S. Cl.
CPC ..... *B41J 3/4075* (2013.01); *B41J 2/32* (2013.01); *B41J 2/335* (2013.01); *B41J 25/312* (2013.01)

(58) Field of Classification Search
CPC ... B41J 3/4075; B41J 2/32; B41J 2/335; B41J 25/312
See application file for complete search history.

(56) References Cited

U.S. PATENT DOCUMENTS

2016/0096382 A1* 4/2016 Kojima ..... B41J 2/325 347/220
2018/0037036 A1* 2/2018 Delario ..... B41J 11/14

FOREIGN PATENT DOCUMENTS

DE 3733785 A1 4/1988
DE 10116584 A1 9/2002
(Continued)

OTHER PUBLICATIONS

Second International Search Report for WO 2017/076533—English Translation, WIPO. (Year: 2018).*

*Primary Examiner* — David H Banh
(74) *Attorney, Agent, or Firm* — Rankin, Hill & Clark LLP

(57) ABSTRACT

A device (1) for printing labels (2) by means of thermal printing using a thermal head (3), which has a thermal strip (4), having a counter-pressure element carrier (5), which has a counter-pressure element (6), wherein an insertion gap (7) is formed between the thermal strip (4) and the counter-pressure element (6), through which the label (2) to be printed in each case can be guided, wherein the thermal head (3) is fastened in a movable manner on a thermal head carrier (8) and wherein the thermal strip (4) is pressed with a predetermined contact pressure against the counter-pressure element (6). To reduce the operating costs, the counter-pressure element (6) is movable relative to the insertion gap (7). A method for printing labels (2) using the device (1) is also disclosed.

24 Claims, 3 Drawing Sheets

Figure 1:
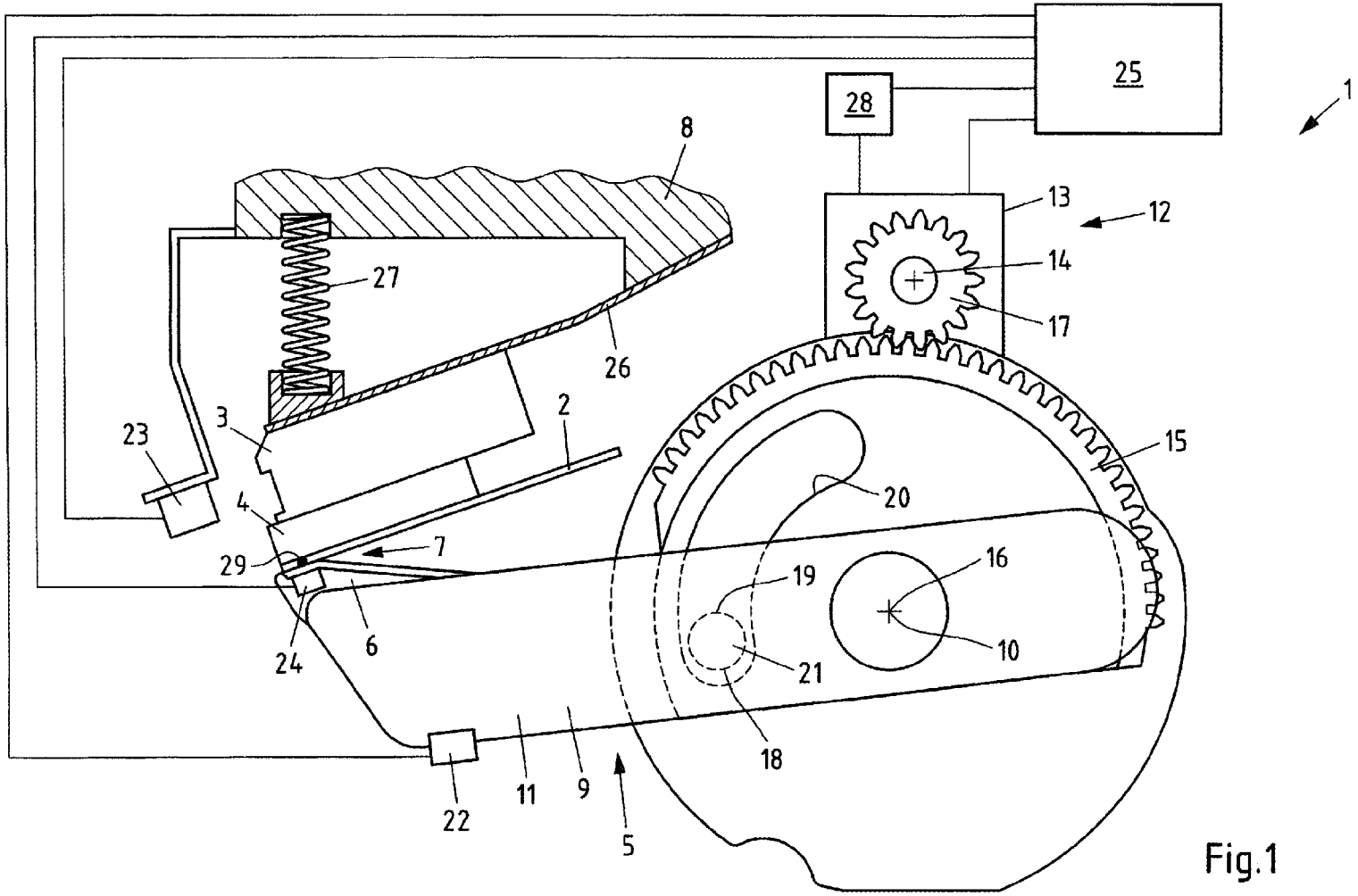

(51) Int. Cl.
*B41J 2/335* (2006.01)
*B41J 25/312* (2006.01)

(56) References Cited

FOREIGN PATENT DOCUMENTS

| | | | | |
|---|---|---|---|---|
| EP | 0856409 | A2 | | 8/1998 |
| GB | 2250717 | A | | 6/1992 |
| GB | 2309960 | A | | 8/1997 |
| JP | 05116353 | A | * | 5/1993 |
| JP | H05116353 | A | | 5/1993 |
| JP | 2005305936 | A | * | 11/2005 |
| WO | 02092438 | A2 | | 11/2002 |

* cited by examiner

DEVICE AND METHOD FOR PRINTING LABELS BY MEANS OF THERMAL PRINTING

The present invention relates to a device for printing labels by means of thermal printing using a thermal head, which has a thermal strip, having a counter-pressure element carrier, which has a counter-pressure element, wherein an insertion gap is formed between the thermal strip and the counter-pressure element, through which the label to be printed in each case can be guided, wherein the thermal head is fastened in a movable manner on a thermal head carrier and wherein the thermal strip is pressed with a predetermined contact pressure against the counter-pressure element (during printing operation and/or when the counter-pressure element is in an operating position). Furthermore, the invention relates to a method for printing labels using such a device.

Thermal printing denotes a technology, in which a thermosensitive medium changes colour, is blackened in particular, due to the punctiform action of heat at the site of the action of heat. The punctiform action of heat is effected by means of one or more rows of small heating resistors, which are arranged in the thermal strip of the thermal head. Each heating resistor, also termed dot, can be controlled and heated individually. In thermal printing, one makes a distinction between direct thermal printing, thermal transfer printing and thermal sublimation printing. In direct thermal printing, thermosensitive paper is blackened directly by means of the punctiform action of heat at the site of the heat input. Special paper for direct thermal printing is also known, which generates different colours at the site of the heat input for the action of heat at different strengths. In thermal transfer printing, the paper to be printed is not guided directly past the thermal strip, but rather the paper is guided past the thermal strip together with a special film (transfer film), wherein the transfer film is arranged between the paper and the thermal strip. The colour layer located on the transfer film melts in the region of the heat input due to the punctiform action of heat and is absorbed by the adjacent paper. A transfer film is also arranged between the paper to be printed on and the thermal strip in thermal sublimation printing. However, here, the colour layer does not melt on the transfer film due to the punctiform heat input, rather, the dye transitions into the gaseous state and is absorbed by the adjacent paper.

The previous methods are also used for printing labels. In particular, thermosensitive labels, preferably self-adhesive labels, are guided past the thermal strip of the printer. The labels are either self-adhesive labels arranged in a detachable manner on a carrier strip or carrier-free labels (linerless labels), which are provided as a continuous strand and are separated by cutting. The labels and/or the carrier strip can consist of paper or plastic. All of these label types, which are in particular provided as rolled material and arranged in the printer, are also part of the invention, which is described in detail below.

To adapt the printing device to different print media and print media thicknesses, it is known from the prior art to change the contact pressure of the thermal strip. To this end, the thermal strip is mounted in the printer in a movable manner, wherein the position of the thermal strip and therefore the contact pressure, with which the thermal strip is pressed against the counter-pressure element, can be adjusted individually. An adjustment of a thermal strip by means of a stepper motor is for example known from DE 37 33 785 A1, DE 101 16 584 B4 and JP 05-116353 A.

Furthermore, a stepper motor for adjusting the thermal strip is likewise known from GB 2 250 717 A, wherein a manual adjustment by means of a handwheel is also possible, however. In all cases, the counter-pressure element is fixed, that is to say non-adjustable.

Furthermore, an alternative printing device is known from GB 2 250 717 A, in which, for the case that in addition to paper to be printed on, a thermal transfer film is also entrained, instead of the thermal strip, the counter-pressure element can be adjusted.

A known problem in thermal printing is that the dots age over time and as a result generate less heat. The consequence is an impairment of the print quality on the printed labels. It is therefore necessary, after a certain period of operation, to replace the thermal strip, which increases the operating costs.

On this basis, it is an object of the present invention to specify a device for printing labels by means of thermal printing, using which the operating costs can be reduced in the most simple way possible.

According to a first teaching of the present invention, in the case of a device for printing labels by means of thermal printing, particularly direct thermal printing, using a thermal head (thermal printing head), which has a thermal strip (thermal printing strip), with a counter-pressure element carrier, which has a counter-pressure element, particularly in the form of an immovable strip or rotatable roller, wherein an insertion gap is formed between the thermal strip and the counter-pressure element, through which the label to be printed in each case can be guided, wherein the thermal head is fastened in a movable manner on a thermal head carrier and wherein (at least during printing operation and/or when the counter-pressure element is located in an operating position) the thermal strip is or can be pressed against the counter-pressure element with a predetermined (defined), particularly adjustable, contact pressure (mechanical pretensioning), the object, which is derived and shown previously, is achieved in that the counter-pressure element is movable relative to the insertion gap.

If it is determined that the print quality has deteriorated, during the printing process, the contact pressure of the thermal strip against the counter-pressure element can be increased in that the counter-pressure element can be moved relative to the insertion gap, particularly in the direction of the insertion gap, i.e. towards the insertion gap (as a result of which the insertion gap is made smaller), and correspondingly also in the opposite direction, i.e. away from the insertion gap (as a result of which the insertion gap is enlarged), and can be pressed against the thermal strip. According to the invention, for the regular readjustment of the contact pressure, it is therefore not the generally spring-mounted thermal strip which is driven together with the thermal head and the spring elements, but rather the printing element or the counter-pressure element carrier. On the one hand, this has the advantage that during the printing, fewer individual parts have to be moved than if the entire thermal head with mount is moved. On the other hand, one advantage is that, due to the possibility of moving the counter-pressure element or the counter-pressure element carrier, the interior of the printing device can also be exposed and made accessible for maintenance personnel, in that the counter-pressure element or the counter-pressure element carrier is moved away from the thermal strip into an open end position (maintenance position). This movement can be a translational movement (linear movement) or pivot movement. In the latter case, it is for example conceivable to pivot away the counter-pressure element carrier relative to an end position (an operating position), in which the counter-pressure element carrier bears against the thermal strip with a maximum contact pressure, by at least 45°, preferably by at least 60°, particularly preferably by at least 90°, in order as a result to create an inspection opening, through which the interior can be accessed well.

This in turn also makes it possible to clean and replace the thermal strip easily. In addition, this makes it possible to carry out an exchange of the label rolls (voucher rolls) in the printer. Thus, as already described at the beginning, labels are generally rolled up as a continuous strip, wherein the labels are either located on a carrier strip in a detachable manner or are linerless labels. During printing, the label rolls are slowly unwound and must be replaced with a new roll at a given time. This can be carried out through the previously described inspection opening, without a separate inspection opening being necessary for that.

In the following, various embodiments of the device according to the invention, that is to say the thermal printer according to the invention, are described which embodiments are also the subject matter of the dependent claims.

According to one embodiment, as previously indicated, a section of the counter-pressure element carrier or the entire counter-pressure element carrier is linearly or pivotably (rotationally) movable relative to the insertion gap or in and counter to the direction of the insertion gap. In this manner, the counter-pressure element can be moved linearly or pivoted in the direction towards the insertion gap or towards the thermal strip, which makes it possible to change a contact pressure of the thermal strip on the counter-pressure element.

According to a further embodiment of the device according to the invention, the counter-pressure element carrier can be pivoted about a pivot axis parallel to the insertion gap. In particular in this case, the counter-pressure element carrier has a lever arm, which extends from the pivot axis to the counter-pressure element carrier. The lever arm, which in particular is identical to the previously described section of the counter-pressure element carrier, carries the counter-pressure element and displaces the position thereof when the counter-pressure element carrier is moved.

According to another further embodiment of the device according to the invention, the counter-pressure element carrier is connected via a gear mechanism to a motor, which has a motor shaft in particular. In particular, the motor is an electric motor, preferably a path-controlled motor, for example a stepper motor, or a force-controlled motor, for example a DC, EC or AC motor. The motor effects the movement of the counter-pressure element carrier when the motor is switched on or actuated. In this case, the gear mechanism preferably has at least one wheel or wheel segment which is connected in a rotationally fixed (immovable) manner to the counter-pressure element carrier, the rotational axis of which wheel or wheel segment runs coaxially to the pivot axis of the counter-pressure element carrier, and a drive wheel, which is driven by the motor, in particular is connected in a rotationally fixed manner to the motor shaft. The drive wheel then transmits the movement of the motor to the wheel or wheel segment, which in turn transmits the movement further to the counter-pressure element carrier. Drive wheel and wheel or wheel segment can be connected to one another directly or by means of a belt. In this case, the wheel is in particular a gear wheel or the wheel segment is a gear-wheel segment. The drive wheel is then constructed as a drive pinion and therefore likewise constructed as a gear wheel.

According to another embodiment of the device according to the invention, the counter-pressure element or the counter-pressure element carrier interacts, in particular by means of the wheel or wheel segment, with a first stop, which delimits the movement of the counter-pressure element in the direction of the insertion gap (towards the insertion gap), and/or interacts with a second stop, which delimits the movement of the counter-pressure element in the direction away from the insertion gap. A first stop of this type in particular defines a first end position, in which the contact pressure of the thermal strip on the counter-pressure element has a maximum value. The second stop in particular defines a further end position, which is used for maintenance purposes and in which the counter-pressure element carrier is at a maximum distance from the first end position. In this further end position (maintenance position), the counter-pressure element does not touch the thermal strip, so that the contact pressure is also 0.

In particular, it is conceivable that the counter-pressure element carrier or the wheel or wheel segment has a groove or a slot, in which a fixed projection, particularly a bolt, is guided, which forms the first stop and/or second stop. The groove or the slot in particular has a curved course, such that the centre line of the groove or of the slot runs on a circular line, which always has the same spacing from the pivot axis. The projection is arranged fixedly and within the groove or the slot at least in certain sections, wherein the groove or the slot can be moved relatively to the projection, in particular between the first end position with the maximum value for the contact pressure and the further end position, in which the counter-pressure element is spaced from the thermal strip. Alternatively, it is also conceivable that the counter-pressure element carrier or the wheel or wheel segment has a projection, which is guided in a fixed groove or a fixed slot or interacts with a fixed projection, wherein the respective fixed element then forms the first stop and/or second stop. In this case also, the groove or the slot can in particular have a curved course, such that the centre line of the groove or of the slot runs on a circular line, which always has the same spacing from the pivot axis. The respective fixed element is fixed in the printing device and in particular part of a housing, which covers and/or surrounds the counter-pressure element carrier or the wheel or wheel segment at least in certain sections.

According to a further embodiment of the device according to the invention, it is provided that two or more of the elements thermal head carrier, pivot axis, motor, first stop and second stop are immovable (fixed) relative to one another. The respective elements are not movable inside the device and always have the same spacing from one another. However, this does not preclude the printing device as a whole being mounted in a movable manner.

According to another embodiment of the device according to the invention, the device, particularly the counter-pressure element or the counter-pressure element carrier, has at least one position sensor. The position sensor is set up in particular for detecting the position of the counter-pressure element or counter-pressure element carrier relatively to an element (component), which is arranged fixedly with respect to the thermal head carrier, on which the thermal head is mounted in a movable manner. The position sensor is provided additionally or alternatively to the first and/or second stop. At least one counter can also be provided additionally or alternatively to the at least one position sensor. A counter in particular counts the steps (full steps or partial steps) of the stepper motor, by means of which precise conclusions about the position of the counter-pressure element or counter-pressure element carrier relative to the fixed element are likewise possible. The detection of the precise position of the counter-pressure element or counter-pressure element carrier has the advantage that it is possible to travel exactly to the end positions or else also a further position (further operating position) spaced from the first end position (first operating position), in which further position, although the counter-pressure element is still touching the thermal strip, the contact pressure is lower than in the end position or operating position with the maximum value for the contact pressure. In such an intermediate position, the contact pressure is in particular chosen in such a manner that the print quality is still good enough, but the thermal strip wear turns out to be as low as possible. Should the print quality then deteriorate in the course of the operating period, the contact pressure can be increased by adjusting the position of the counter-pressure element or counter-pressure element carrier.

Again, according to a further embodiment of the device according to the invention, the device has at least one optical sensor. In particular, the optical sensor is configured for detecting the degree of blackening or colour intensity of a printed region of a label. The optical sensor, which is a camera for example, is preferably arranged behind the thermal strip in the direction in which the label to be printed is transported, particularly in a position in which the degree of blackening or colour intensity of the label can already be detected, whilst the label is still being printed and/or the following label is not yet printed. The optical sensor makes it possible, which is described in more detail in the following, to increase the degree of blackening or colour intensity if the degree of blackening or colour intensity falls below a predetermined reference value over time.

According to another further embodiment of the device according to the invention, the device, particularly the counter-pressure element or the counter-pressure element carrier, has a pressure sensor. The pressure sensor is in particular configured for detecting the contact pressure of the thermal strip on the counter-pressure element. Preferably, the pressure sensor is integrated into the counter-pressure element. However, it is also conceivable that the pressure sensor is integrated into the thermal strip or is arranged at a different location between the thermal head and counter-pressure element carrier. A pressure sensor of this type enables the exact detection and adjustment of the contact pressure and is therefore a preferred complement for the previously mentioned other sensors.

According to another embodiment of the device according to the invention, this device furthermore has a control device, which in particular controls the movement of the counter-pressure element or the section or lever arm of the counter-pressure element carrier in the direction of the insertion gap. Preferably, the control device is constructed (configured) in such a manner that the control device controls the movement of the counter-pressure element or the section or lever arm of the counter-pressure element carrier depending on

- values of the temperature or the electrical resistance of individual or all heating resistors of the thermal strip read out from the thermal strip, and/or
- sensor signals of the position sensor and/or counter and/or optical sensor and/or pressure sensor.

According to another embodiment of the device, the control device is constructed (configured) in such a manner that it executes the following steps successively (in the specified sequence):

(a) moving the counter-pressure element relatively to the insertion gap or in or counter to the direction of the insertion gap into a first position, in which the contact pressure, with which the thermal strip is pressed against the counter-pressure element, is smaller than in an end position defined by the first stop or position sensor or the counter, in which end position, the contact pressure has a maximum value, (b) detecting a degree of blackening or colour intensity by means of the optical sensor, (c) comparing the detected degree of blackening or colour intensity with a predetermined (saved) reference value or reference value range for the degree of blackening or colour intensity, (d) moving the counter-pressure element in the direction of the thermal strip into a further position, in which the contact pressure is larger than in the first position, if the detected degree of blackening or colour intensity is smaller than the reference value or reference value range.

In this manner, it is possible, in an automated manner in particular, in the case of a decreasing degree of blackening or colour intensity, to increase the contact pressure and as a result to correspondingly also increase the degree of blackening or colour intensity without the thermal strip or the thermal head having to be replaced. If the counter-pressure element has been adjusted so often until it is in the end position, in which the contact pressure is at maximum, the thermal strip can be replaced as soon as the degree of blackening or colour intensity again falls below the reference value or value range. Accordingly, according to a further embodiment, the control device is constructed (configured) in such a manner that the steps (b) to (d) are repeated in sequence until the further position corresponds to the end position. The control device can then also generate a warning signal in the end position, particularly immediately after the end position is reached in the previously described manner and/or after the degree of blackening or colour intensity in the end position falls below the reference value or value range, which warning signal indicates replacement time for the thermal strip to a user.

Alternatively to detecting the degree of blackening or colour intensity by means of an optical sensor, it is also conceivable to read out values of the temperature or the electrical resistance of the heating resistors of the thermal strip and compare the same with a corresponding reference value or value range. Conclusions about the print quality are also possible by this means and the contact pressure can also accordingly be increased on this basis by moving the counter-pressure element in the direction of the thermal strip. Thus, it is also conceivable that the control device is constructed in such a manner that it successively executes the following steps:

(a) moving the counter-pressure element relatively to the insertion gap or in or counter to the direction of the insertion gap into a first position, in which the contact pressure is smaller than in an end position defined by the first stop or position sensor or the counter, in which end position, the contact pressure has a maximum value, (b) reading out a value of the temperature or the electrical resistance of individual or all heating resistors of the thermal strip, (c) comparing the read value of the temperature or the electrical resistance with a predetermined reference value or reference value range for the temperature or the electrical resistance, (d) moving the counter-pressure element in the direction of the thermal strip into a further position, in which the contact pressure is larger than in the first position, if the read out value of the temperature or the electrical resistance is smaller than the reference value or reference value range.

According to another further embodiment of the device according to the invention, the thermal head is resiliently connected to the thermal head carrier, particularly by means of at least one spiral spring, preferably leaf spring, and/or at least one coil spring, preferably compression coil spring. Alternatively or additionally, the counter-pressure element is resiliently connected to the counter-pressure element carrier, particularly by means of at least one spiral spring, preferably leaf spring, and/or at least one coil spring, preferably compression coil spring. The predetermined contact pressure is then a spring force in particular. Preferably, as explained previously, the predetermined contact pressure, spring force in particular, is adjustable.

The previously derived and indicated object is furthermore achieved according to a second teaching of the present invention in a method for printing labels, particularly a device defined as before, in that the following steps are carried out successively (in the indicated sequence):

(a) moving the counter-pressure element in the direction of the thermal strip into a first position, in which the contact pressure is smaller than in an end position defined by a or the first stop delimiting the movement of the counter-pressure element in the direction of the insertion gap or a or the position sensor or a or the counter, in which end position the contact pressure has a maximum value,
(b) detecting a degree of blackening or colour intensity by means of a or the optical sensor,
(c) comparing the detected degree of blackening or colour intensity with a predetermined reference value or reference value range for the degree of blackening or colour intensity,
(d) moving the counter-pressure element in the direction of the thermal strip into a further position, in which the contact pressure is larger than in the first position, if the detected degree of blackening or colour intensity is smaller than the reference value or reference value range.

Alternatively, a method for printing labels using a device as defined previously is conceivable, which method is characterized in that the following steps are carried out successively (in the specified sequence):

(a) moving the counter-pressure element in the direction of the thermal strip into a first position, in which the contact pressure is smaller than in an end position defined by a or the first stop delimiting the movement of the counter-pressure element in the direction of the insertion gap or a or the position sensor or a or the counter, in which end position the contact pressure has a maximum value,
(b) reading out a value of the temperature or the electrical resistance of individual or all heating resistors of the thermal strip,
(c) comparing the read value of the temperature or the electrical resistance with a predetermined reference value or reference value range for the temperature or the electrical resistance,
(d) moving the counter-pressure element in the direction of the thermal strip into a further position, in which the contact pressure is larger than in the first position, if the read out value of the temperature or the electrical resistance is smaller than the reference value or reference value range.

In this case, it is also provided in the method according to the invention according to an embodiment that the steps (b) to (d) are repeated in sequence until the further position corresponds to the end position.

In the method according to the invention, the following two approaches in particular are conceivable for calibrating the device:

Thus, it is conceivable on the one hand that before step (a), the counter-pressure element is moved into its end position defined by means of the first stop or position sensor or the counter and then the contact pressure, particularly spring force, of the thermal strip relative to the counter-pressure element arranged in the end position is adjusted to a predetermined value. Thus, the counter-pressure element or the counter-pressure element carrier is fixed in the end position, so that the same cannot be moved with respect to the fixed elements inside the printing device. Subsequently, the thermal head is moved (displaced) against or in the direction of the counter-pressure element, until the contact pressure reaches a certain value. This certain value corresponds to the previously described maximum contact pressure. For example, as a result, a value for the contact pressure is set in a range of 30 to 55 N, preferably in a range of 35 to 45 N, particularly preferably in a range of 35 to 40 N. Subsequently, the counter-pressure element or the counter-pressure element carrier is moved back somewhat from its end position, particularly by only a few stepper steps (full steps or partial steps) of the stepper motor, in which the contact pressure is lower than the in the end position and in particular forms a compromise between print quality and thermal strip wear. In the case of a decreasing degree of blackening or colour intensity, as explained previously, the counter-pressure element or the counter-pressure element carrier is moved further in the direction of the end position, as a result of which the contact pressure is then increased somewhat again.

Alternatively to the preceding approach, it is also conceivable that prior to step (a), the contact pressure, spring force in particular, is adjusted to a predetermined value by moving the counter-pressure element in the direction of the insertion gap and pressing the counter-pressure element against the thermal strip. In this case, there is no first end position defined by a fixed (stationary) stop in particular. Here, instead, the counter-pressure element carrier or the counter-pressure element is moved out of a position, in which the counter-pressure element does not touch the thermal strip at all or only touches the thermal strip with a relatively small contact pressure, in the direction of the insertion gap or the thermal strip, until the contact pressure has a value, which corresponds to the previously mentioned compromise between print quality and thermal strip wear. In particular, the counter-pressure element or the counter-pressure element carrier is moved out of the second end position, in which the counter-pressure element is spaced from the thermal strip (maintenance position), into the said position forming the compromise between print quality and thermal strip wear. The number of stepper steps (full steps or partial steps) of a stepper motor between these two positions can then be saved and thus enables a reproducible start-up of the optimum thermal strip contact pressure. Because, as mentioned, there is preferably no end position or no stop for the counter-pressure element in the direction of the insertion gap, the contact pressure can be adjusted to be almost as high as desired.

The present invention has the advantage that, with respect to the position determined during the initial mounting, the movable counter-pressure element or the movable counter-pressure element carrier can be traveled into almost any desired positions, which consequently leads to different contact pressures, which can be adjusted by the user if they would like to have an active influence on the degree of blackening or colour intensity of the thermal strip print.

Figure 2:
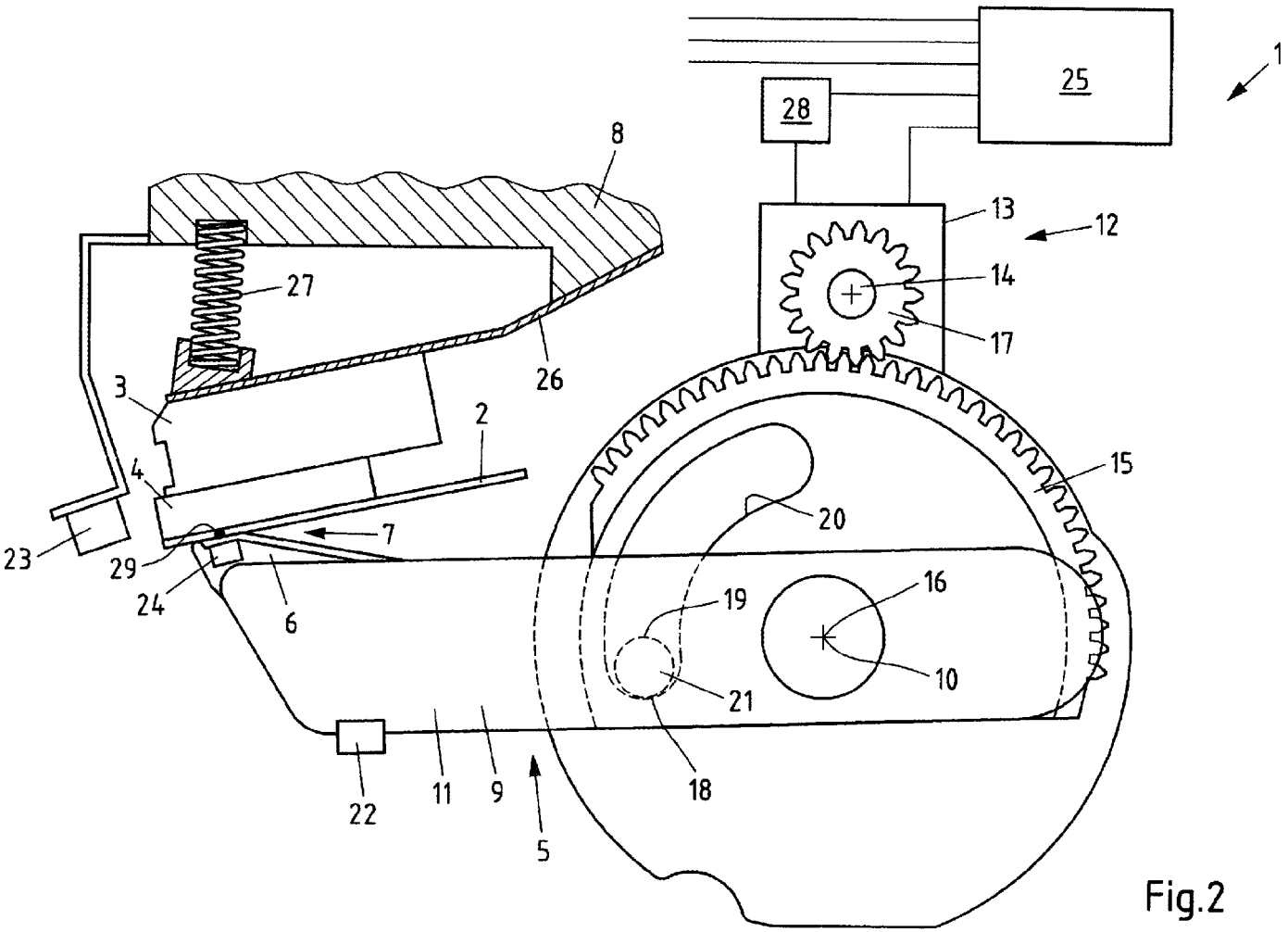
Figure 3:
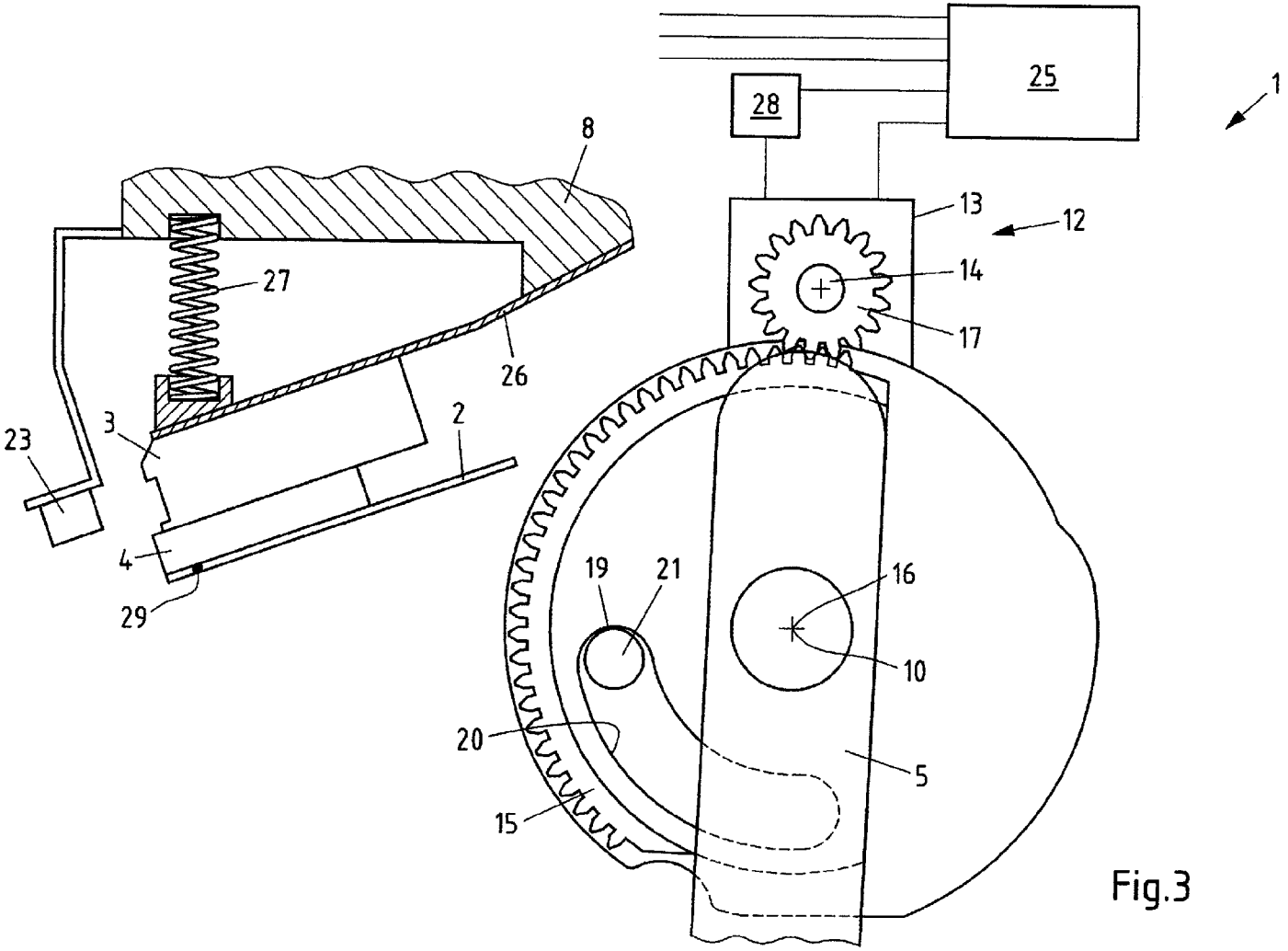

There is a multiplicity of possibilities for configuring and developing the device according to the invention and the method according to the invention. In this regard, reference may be made to the patent claims dependent on Patent Claims 1 and 21 on the one hand, and to the description of an exemplary embodiment on the other hand in connection with the drawing. In the drawing:

FIG. 1 shows a device for printing labels by means of thermal printing in a first setting, FIG. 2 shows a device for printing labels by means of thermal printing in a second setting, and FIG. 3 shows a device for printing labels by means of thermal printing in a third setting.

The device 1 shown in FIGS. 1 to 3 is used for printing labels 2 for example by means of direct thermal printing. The labels 2 are by way of example self-adhesive labels 2 here, which are arranged in a detachable manner on a carrier strip (not illustrated), which is mounted in an unwindable manner as rolled material in the printing device or the printer 1.

The printing device 1 has a thermal head 3 with a thermal strip 4, wherein the thermal strip 4 has a multiplicity of heating resistors (dots) 29, by means of which a printed image of a certain print quality is created on the upper side of the respective label 2, which is guided past the thermal strip 4.

The thermal head 3 is resiliently connected to a thermal head carrier 8 together with the thermal strip 4, here for example by means of a spiral spring 26 constructed as a leaf spring and/or a coil spring 27 constructed as a compression coil spring (here both springs are illustrated for better understanding, although also only one spring or even no spring may be provided). The thermal head carrier 8 is arranged in a fixed manner, that is to say in a non-movable manner, in the device 1.

A counter-pressure element 6 is arranged on the side opposite the thermal strip 4, that is to say here below the label 2, which counter-pressure element is a constituent of a pivotably arranged counter-pressure element carrier 5. The counter-pressure element 6 is here constructed as a strip coated with printing felt, but can fundamentally also be constructed as a print roller.

An insertion gap 7 is formed between the thermal strip 4 and the counter-pressure element 6, through which the label 2 is guided. In this state, the thermal strip 4 presses against the counter-pressure element 6 and thus holds the label 2 or the carrier strip during the printing process in connection with a pulling device (not illustrated), e.g. a winding device for the carrier strip, under tension.

The contact pressure, with which the thermal strip 4 presses against the counter-pressure element 6 during printing operation or in one of the operating positions, is on the one hand determined by the spring force of the springs 26 and 27 and on the other hand by the position of the counter-pressure element carrier 5 or counter-pressure element 6. Thus, the counter-pressure element carrier 5 can be pivoted about a pivot axis 10 running parallel to the insertion gap 7, as a result of which a section 9 or lever arm 11 of the counter-pressure element carrier 5 moves relatively to the insertion gap 7, that is to say in the direction of the insertion gap 7 or counter to the direction of the insertion gap 7. In this case, in the operating position of the counter-pressure element 5 shown in FIG. 1, the contact pressure is still relatively low, whereas in the operating position shown in FIG. 2 (first end position) the contact pressure is at a maximum. In this manner, it is possible, starting with the position shown in FIG. 1, to move the counter-pressure element 6 or the counter-pressure element carrier 5 over time (during the service lift of the thermal strip 4) step-by-step in the direction of the end position illustrated in FIG. 2, specifically whenever the degree of blackening or colour intensity of the printing falls below a predetermined reference value.

As FIG. 3 shows, the counter-pressure element carrier 5 can also be moved into an open position (second end position or maintenance position). In this open position (which is only illustrated in some sections in FIG. 3 for reasons of clarity), the counter-pressure element 6 no longer touches the thermal strip 4, but rather is spaced so far from the thermal strip 4, that the interior of the device 1 is easily accessible through the thus formed opening between the thermal strip 4 and the counter-pressure element 6, for example for maintenance, cleaning or repair purposes or for the exchange of the label roll or thermal strip.

In order to be able to move the counter-pressure element carrier 5 and correspondingly the counter-pressure element 6 between the illustrated positions, the counter-pressure element carrier 5 is connected via a gear mechanism 12 to a motor 13, which has a motor shaft 14. The motor 13 effects the movements of the counter-pressure element carrier 5. Here, the gear mechanism 12 has a gear wheel segment 15 connected to the counter-pressure element carrier 5, the rotational axis 16 of which runs coaxially to the pivot axis 10, and also a drive pinion 17 driven by the motor 13 and connected in a rotationally fixed manner to the motor shaft 14. The drive pinion 17 engages into the gear wheel segment 15 and thus transmits the rotational movement of the motor shaft 14 to the counter-pressure element carrier 5. The motor 13 is a stepper motor, which is connected to a counter 28. The counter 28 is configured to count the individual steps (full steps or partial steps) in the respective rotational direction of the stepper motor and thus to travel to the individual positions of the counter-pressure element carrier 5 in a reproducible manner.

In addition, the counter-pressure element carrier 5, here in a disc-shaped section, which carries the wheel segment 15, is provided with a groove 20. A fixed, bolt-shaped projection 21 is guided in the groove 20 relatively to the pivot axis 10, which projection forms a first stop 18 on its underside illustrated here and a second stop 19 on its upper side. The first stop 18 delimits the movement of the counter-pressure element 6 in the direction of the insertion gap 7, thus upwards here. The second stop 19 delimits the movement of the counter-pressure element 6 in the direction away from the insertion gap 7, thus downwards here.

In the present exemplary embodiment, the thermal head carrier 8, the pivot axis 10, the motor 13 and the bolt 21 and thus the first and second stops 18 and 19 are non-movable relative to one another. It would however also be conceivable that the thermal head carrier 8 is adjustable.

The counter-pressure element carrier 5 is further provided with a position sensor 22, here on the underside thereof, which position sensor is used for detecting the individual positions of the counter-pressure element carrier 5 or counter-pressure element 6, including at least the positions in FIGS. 1 to 3. Fundamentally, the position sensor 22 can also detect each intermediate position, to which it is possible to travel using the stepper motor 13.

The device 1 additionally has an optical sensor 23, which can be camera. The optical sensor 23 is arranged at a location of the device 1, in which it can detect the degree of blackening or colour intensity of the printed image of this label 2 directly during the printing of a label 2.

Furthermore, a pressure sensor 24 is provided in the counter-pressure element 6, which is used for detecting the contact pressure of the thermal strip 4 on the counter-pressure element 6.

The sensors 22, 23 and 24 and also the counter 28 are (electronically) connected to a control device 25, which is likewise part of the device 1. The control device 25 controls the movement of the counter-pressure element carrier and therefore of the counter-pressure element 6 or the section 9 or lever arm 11 relatively to the insertion gap 7 depending on the sensor signals and the information from the counter 28. In addition, the control device 25 can also be (electronically) connected to the thermal strip and read out values of the temperature or the electrical resistance of individual or all heating resistors 29 of the thermal strip 4.

The printing device 1 according to the invention can be operated as follows with the aid of the control device 25:

Thus, the counter-pressure element 6 can initially be moved to its (first) end position defined by the first stop 18, and then the contact pressure of the thermal strip 4 on the counter-pressure element 6 can be adjusted. The adjustment of the contact pressure takes place by changing the spring force, in that the compression coil spring 27 is adjusted here. Alternatively, it is also conceivable to adjust the spring force of the leaf spring 26 or to change the position of the thermal head carrier 8. The contact pressure is for example adjusted to a value in a range from 30 to 55 N, for example to a value of 50 N. The precise adjustment of the contact pressure takes place by means of the pressure sensor 24 in the counter-pressure element 6. A corresponding setting is illustrated in FIG. 2.

Subsequently, from this end position, the counter-pressure element carrier 5 is moved back by means of the stepper motor 13 by a few stepper steps (full steps or partial steps), until it reaches the position illustrated in FIG. 1. In this position, the contact pressure of the thermal strip 4 against the counter-pressure element 6 is reduced compared to the first end position in FIG. 2, particularly to a value in a range from 25 to 45 N, preferably 30 to 35 N. The value 35 N is exemplary here.

In this position, labels 2 are then printed or the thermal strip 4 is actuated until the optical sensor 23 detects a degree of blackening or colour intensity of the printed image, which lies below a reference value saved in the control device 25. The counter-pressure element carrier 5 is then moved into a position, in which the contact pressure is somewhat larger than before, in that the stepper motor 13 is correspondingly controlled by the control device 25. This takes place in that the stepper motor 13 moves the counter-pressure element carrier 5, for example by a single stepper step, in the direction of the position illustrated in FIG. 2.

Over time, the counter-pressure element carrier 5 and the counter-pressure element 6 increasingly approach the end position illustrated in FIG. 2. When the end position is reached and the degree of blackening or colour intensity detected by the optical sensor 23 falls below the predetermined reference value, the thermal strip 4 or the thermal head 3 must be replaced.

In a variant of the previously described method, it is also possible to dispense with first travelling the counter-pressure element carrier 5 into the first end position illustrated in FIG. 2 and then adjusting the thermal head 3 in such a manner that the desired maximum contact pressure is applied, before first operating the thermal strip 4. Instead, it is also conceivable to move the counter-pressure element carrier 5 out of the second end position illustrated in FIG. 3 or a different position, in which the counter-pressure element 6 does not touch the thermal strip 4, in the direction of the insertion gap 7 or the thermal strip 4, until a contact pressure is present in a range from 25 to 45 N, preferably 30 to 35 N. The number of stepper steps (full steps or partial steps) of the stepper motor 13 necessary therefor is saved in particular, for example by means of the counter 28 in connection with the control device 25, and thus allows a reproducible start-up of the optimum thermal strip contact pressure even in the future, once a new thermal strip has been used.

From the last-mentioned setting, which is illustrated in FIG. 1, the counter-pressure element carrier 5, as described already, is then moved step-by-step over time in the direction of the position illustrated in FIG. 2 and, if no stop is provided, if appropriate also beyond, in order to increase the contact pressure always when the degree of blackening or colour intensity lies below the said reference value. In the latter case, if no stop is provided, the contact pressure can be adjusted to virtually any desired level.

The invention claimed is:

1. A device for printing labels by thermal printing having a thermal head, which has a thermal strip, and a counter-pressure element carrier, which has a counter-pressure element, wherein an insertion gap is formed between the thermal strip and the counter-pressure element, through which said insertion gap the label to be printed in each case is guidable, wherein the thermal head is fastened in a movable manner on a thermal head carrier, wherein the thermal strip is pressed against the counter-pressure element with a predetermined contact pressure, wherein the counter-pressure element is movable relative to the insertion gap, wherein the device further has a control device, and wherein the control device is configured to successively:

(a) move the counter-pressure element into a first position relative to the insertion gap, in which a contact pressure is smaller than in an end position defined by a first stop or position sensor or counter, in which at the end position the contact pressure is at a maximum value, (b) detect a degree of blackening or color intensity using an optical sensor, (c) compare a detected degree of blackening or color intensity with a predetermined reference value or reference value range for the degree of blackening or color intensity, and (d) move the counter-pressure element in a direction of the thermal strip into a further position, in which the contact pressure is larger than in the first position, if the detected degree of blackening or colour intensity is smaller than the reference value or reference value range.

2. The device according to claim 1, wherein a section of the counter-pressure element carrier or all of the counter-pressure element carrier is linearly or pivotably movable relative to the insertion gap.

3. The device according to claim 2, wherein the counter-pressure element carrier is pivotable about a pivot axis parallel to the insertion gap.

4. The device according to claim 3, wherein the counter-pressure element carrier has a lever arm, which extends from the pivot axis to the counter-pressure element.

5. The device according to claim 3, wherein the counter-pressure element carrier is connected via a gear mechanism to a motor having a motor shaft.

6. The device according to claim 5, wherein the gear mechanism has at least one wheel or wheel segment, which is connected in a rotationally fixed manner to the counter-pressure element carrier, wherein the rotational axis of the gear wheel or wheel segment runs coaxially to the pivot axis of the counter-pressure element carrier, and a drive pinion, which is driven by the motor and is connected in a rotationally fixed manner to the motor shaft.

7. The device according to claim 5, wherein the motor is a stepper motor.

8. The device according to claim 6, wherein the counter-pressure element or the counter-pressure element carrier interacts via the wheel or wheel segment, with a first stop, which delimits movement of the counter-pressure element in the direction of the insertion gap, and/or interacts with a second stop, which delimits movement of the counter-pressure element in a direction away from the insertion gap.

9. The device according to claim 8, wherein the counter-pressure element carrier or the wheel or wheel segment has a groove or a slot, in which a projection is guided, and which forms the first stop and/or second stop.

10. The device according to claim 8, wherein two or more of the thermal head carrier, pivot axis, motor, first stop and second stop are immovable relative to one another.

11. The device according to claim 5, wherein the device has at least one position sensor or the motor has at least one counter.

12. The device according to claim 11, wherein the device has at least one pressure sensor.

13. The device according to claim 4, wherein the control device controls movement of the counter-pressure element or of the section of the counter-pressure element carrier or of the lever arm of the counter-pressure element carrier in the direction of the insertion gap.

14. The device according to claim 12, wherein the control device is configured in such a manner that it controls movement of the counter-pressure element or of the section of the counter-pressure element carrier or of the lever arm of the counter-pressure element carrier depending on sensor signals of the position sensor and/or counter and/or optical sensor and/or pressure sensor.

15. The device according to claim 1, wherein the control device is configured in such a manner that steps (b) to (d) are repeated in sequence until the further position corresponds to the end position.

16. The device according to claim 1, wherein the thermal head is resiliently connected to the thermal head carrier via at least one spiral spring and/or at least one coil spring, and the predetermined contact pressure is a spring force.

17. The device according to claim 16, wherein the predetermined contact pressure provided by the spring force is adjustable.

18. A method for printing labels using a device according to claim 1, said method comprising successive steps of:

(a) moving the counter-pressure element in the direction of the thermal strip into the first position, in which the contact pressure is smaller than in the end position defined by the first stop delimiting the movement of the counter-pressure element in the direction of the insertion gap or a position sensor or a counter, in which end position the contact pressure has the maximum value, (b) detecting the degree of blackening or color intensity using the optical sensor, (c) comparing the detected degree of blackening or color intensity with the predetermined reference value or reference value range for the degree of blackening or colour intensity, and (d) moving the counter-pressure element in the direction of the thermal strip into the further position, in which the contact pressure is larger than in the first position, if the detected degree of blackening or color intensity is smaller than the reference value or reference value range.

19. The method according to claim 18, wherein the steps (b) to (d) are repeated in sequence until the further position corresponds to the end position.

20. The method according to claim 18, wherein, before step (a), the counter-pressure element is moved into its end position defined by the first stop or position sensor or the counter and then the contact pressure of the thermal strip relative to the counter-pressure element arranged in the end position is adjusted to the predetermined value.

21. The method according to claim 18, wherein, prior to step (a), the contact pressure is adjusted to the predetermined value by moving the counter-pressure element in the direction of the insertion gap and pressing the counter-pressure element against the thermal strip.

22. A device for printing labels by thermal printing having a thermal head, which has a thermal strip, and a counter-pressure element carrier, which has a counter-pressure element, wherein an insertion gap is formed between the thermal strip and the counter-pressure element, through which insertion gap the label to be printed in each case is guidable, wherein the thermal head is fastened in a movable manner on a thermal head carrier, wherein the thermal strip is pressed against the counter-pressure element with a predetermined contact pressure, wherein the counter-pressure element is movable relative to the insertion gap, wherein the device further has a control device, and wherein the control device is configured in such a manner that it controls movement of the counter-pressure element or of a section of the counter-pressure element carrier or of a lever arm of the counter-pressure element carrier depending on values of temperature or electrical resistance of individual or all heating resistors of the thermal strip read out from the thermal strip.

23. The device according to claim 22, wherein the device has at least one optical sensor.

24. A method for printing labels using a device according to claim 22, said method comprising successive steps of:

(a) moving the counter-pressure element in the direction of the thermal strip into the first position, in which the contact pressure is smaller than in the end position defined by the first stop delimiting the movement of the counter-pressure element in the direction of the insertion gap or a position sensor or a counter, in which end position the contact pressure has the maximum value, (b) reading out the value of the temperature or the electrical resistance of individual or all heating resistors of the thermal strip, (c) comparing the read value of the temperature or the electrical resistance with the predetermined reference value or reference value range for the temperature or the electrical resistance, and (d) moving the counter-pressure element in the direction of the thermal strip into the further position, in which the contact pressure is larger than in the first position, if the read out value of the temperature or the electrical resistance is smaller than the reference value or reference value range.

* * * * *